US009938885B2

(12) United States Patent
Zahdeh et al.

(10) Patent No.: US 9,938,885 B2
(45) Date of Patent: Apr. 10, 2018

(54) MANIFOLD FOR AN ENGINE ASSEMBLY

(71) Applicant: GM GLOBAL TECHNOLOGY OPERATIONS LLC, Detroit, MI (US)

(72) Inventors: Akram R. Zahdeh, Rochester Hills, MI (US); Steven M. Yocum, Addison Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 407 days.

(21) Appl. No.: 14/692,036

(22) Filed: Apr. 21, 2015

(65) Prior Publication Data

US 2016/0252001 A1 Sep. 1, 2016

Related U.S. Application Data

(60) Provisional application No. 62/121,226, filed on Feb. 26, 2015.

(51) Int. Cl.

| | |
|---|---|
| ***F01P 1/06*** | (2006.01) |
| ***F01P 11/02*** | (2006.01) |
| ***F01P 3/12*** | (2006.01) |

(52) U.S. Cl.

CPC ..... *F01P 11/0285* (2013.01); *F01P 3/12* (2013.01); *F01P 2060/12* (2013.01); *F01P 2060/16* (2013.01)

(58) Field of Classification Search

USPC ..... 123/41.31

See application file for complete search history.

(56) References Cited

U.S. PATENT DOCUMENTS 4,214,443 A * 7/1980 Herenius ..... F01N 3/046 123/41.48
4,300,718 A * 11/1981 Beyer ..... F01P 11/0285 123/41.09

(Continued)

FOREIGN PATENT DOCUMENTS

CN 101608568 A 12/2009
CN 101644201 a 2/2010

(Continued)

*Primary Examiner* — Lindsay Low
*Assistant Examiner* — Ruben Picon-Feliciano
(74) *Attorney, Agent, or Firm* — Quinn IP Law

(57) ABSTRACT

An engine assembly includes a turbocharger and a fluid conduit. The fluid conduit is thermally coupled to the turbocharger such that the coolant flowing through the fluid conduit can extract heat from the turbocharger. The engine assembly includes a surge tank and an engine head defining a coolant gallery. Further, the engine assembly includes an exhaust manifold integrated with the engine head. The coolant gallery is thermally coupled to the exhaust manifold such that the coolant can extract heat from the exhaust manifold. The engine assembly further includes a coolant manifold in fluid communication with the fluid conduit and the coolant gallery. The coolant manifold defines a venting orifice in fluid communication with the surge tank. Further, the coolant manifold defines a joint passageway in fluid communication with the fluid conduit. Moreover, the coolant manifold defines an interconnection passageway fluidly interconnecting the joint passageway and the coolant gallery.

11 Claims, 2 Drawing Sheets

(56) References Cited

U.S. PATENT DOCUMENTS

| | | | | | |
|---|---|---|---|---|---|
| 4,358,051 | A * | 11/1982 | Hunt | F01P 7/16 | 123/41.1 |
| 4,605,164 | A * | 8/1986 | Hayashi | B60H 1/00314 | 123/41.08 |
| 2002/0166516 | A1* | 11/2002 | Song | F01P 3/02 | 123/41.1 |
| 2009/0114171 | A1* | 5/2009 | Hayashi | F01P 3/02 | 123/41.44 |
| 2015/0208525 | A1* | 7/2015 | Negishi | H05K 5/0056 | 361/752 |

FOREIGN PATENT DOCUMENTS

| | | | |
|---|---|---|---|
| CN | 102269037 | A | 12/2011 |
| CN | 102953799 | A | 3/2013 |
| CN | 202832743 | U | 3/2013 |

* cited by examiner

MANIFOLD FOR AN ENGINE ASSEMBLY

CROSS-REFERENCE TO RELATED APPLICATIONS

This application claims the benefit of U.S. Provisional Application No. 62/121,226, filed Feb. 26, 2015, which is hereby incorporated by reference in its entirety.

TECHNICAL FIELD

The present disclosure relates to a coolant manifold, such as a Y-manifold, for an engine assembly.

BACKGROUND

In a vehicle, an engine assembly may include cooling systems to cool various vehicle components. For example, a turbocharger may employ a cooling system to maintain an optimum temperature during operation. Similarly, a vehicle may include an exhaust cooling system. A suitable coolant can be used in those cooling systems. After the cooling process, the coolant is usually hot.

SUMMARY

To maximize fuel efficiency when an internal combustion engine is warming up, the engine oil should be heated to an optimum temperature as quickly as possible. When the oil is at its optimum temperature, fuel dilution in the oil can be minimized. In addition, the moisture in the oil can be minimized by maintaining the oil temperature at its optimum level, thereby maximizing the engine oil life. Accordingly, heat can be extracted from the turbocharger and/or an exhaust manifold in order to warm up the engine oil. For example, coolant can extract heat from the turbocharger and can then be mixed with the coolant in a coolant gallery. In the present disclosure, the term "coolant" refers to any fluid (e.g., liquid) suitable for transferring heat. As a non-limiting example, the coolant F may be ethylene glycol. The resulting hot coolant can then be used to heat the engine oil. A manifold, such as a Y-manifold, can be used to direct coolant to the coolant gallery. In an embodiment, the presently disclosed engine assembly includes a turbocharger and a fluid conduit configured to carry coolant. The fluid conduit is thermally coupled to the turbocharger such that the coolant flowing through the fluid conduit can extract heat from the turbocharger. The engine assembly further includes a surge tank and an engine head defining a coolant gallery. The coolant gallery is configured to carry coolant. The engine assembly further includes an exhaust manifold integrated with the engine head. The coolant gallery is thermally coupled to the exhaust manifold such that the coolant can extract heat from the exhaust manifold. The engine assembly further includes a coolant manifold in fluid communication with the fluid conduit and the coolant gallery. The coolant manifold defines a venting orifice in fluid communication with the surge tank in order to allow vapors to vent from the coolant manifold to the surge tank. Further, the coolant manifold defines a joint passageway in fluid communication with the fluid conduit in order to allow the coolant to flow from the fluid conduit to the coolant manifold. Moreover, the coolant manifold defines an interconnection passageway fluidly interconnecting the joint passageway and the coolant gallery in order to allow the coolant to flow from the joint passageway to the coolant gallery. During operation of the engine assembly, the coolant extracts heat from the turbocharger and is then carried to the joint passageway of the coolant manifold. Further, vapors of the coolant are vented through the venting orifice of the coolant manifold and into the surge tank. Then, the coolant is carried from the coolant manifold to the coolant gallery.

The above features and advantages and other features and advantages of the present teachings are readily apparent from the following detailed description of the best modes for carrying out the teachings when taken in connection with the accompanying drawings.

DETAILED DESCRIPTION

Figure 1:
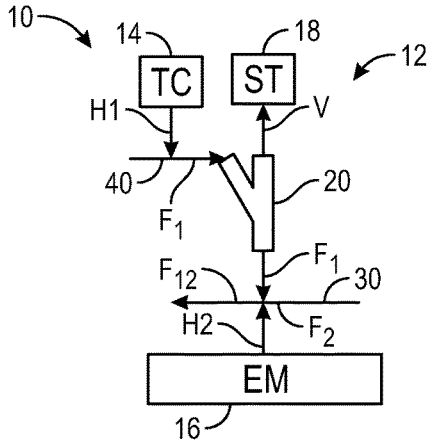
FIG. 1 is a schematic illustration of an engine assembly including a turbocharger, a manifold, a surge tank, and an exhaust manifold.
Figure 2:
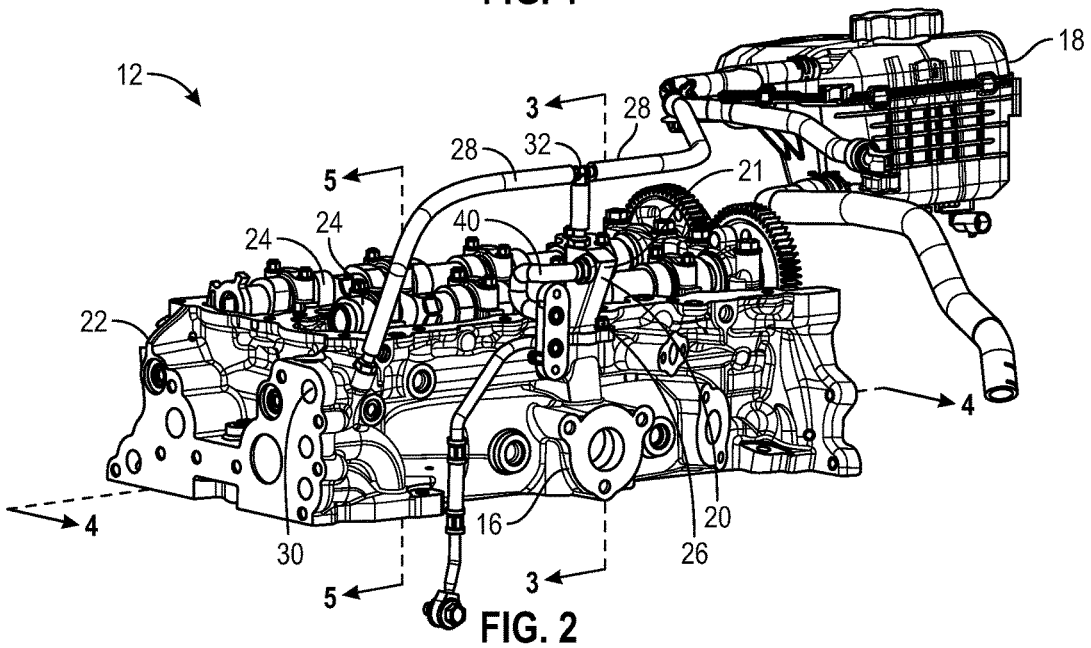
FIG. 2 is a schematic, perspective view of the engine assembly schematically illustrated in FIG. 1, including an engine head and the coolant manifold coupled to the engine head.
Figure 3:
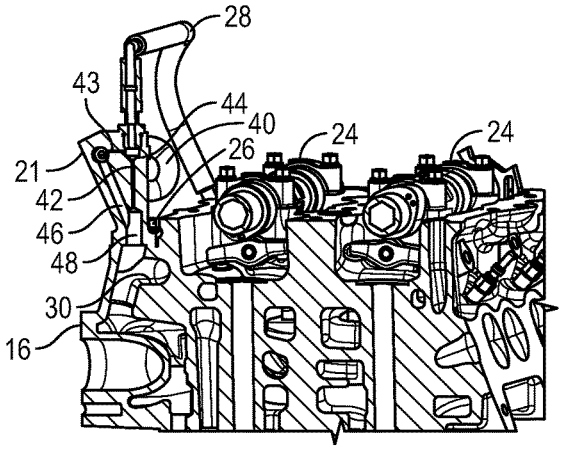
FIG. 3 is a schematic, sectional, perspective front view of the engine head and the coolant manifold, taken along section line 3-3 of FIG. 2.
Figure 4:
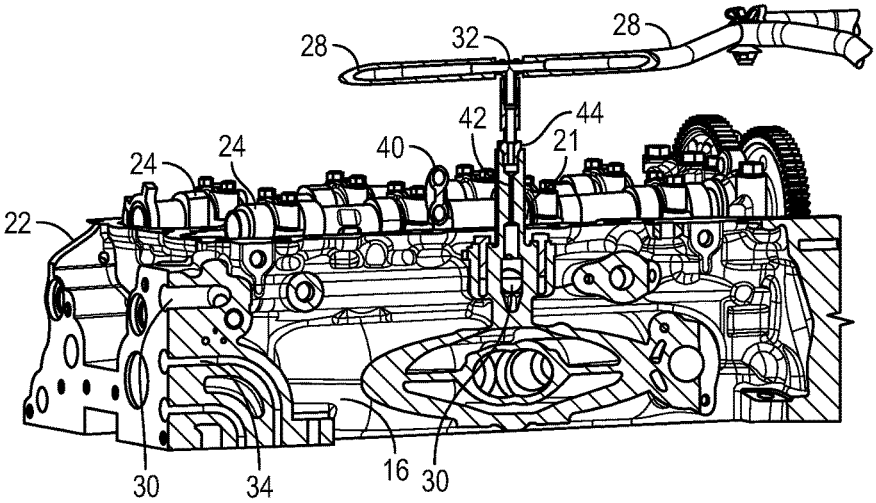
FIG. 4 is a schematic, sectional, perspective side view of the engine head and the coolant manifold, taken along section line 4-4 of FIG. 2.

Referring to the drawings, wherein like reference numbers correspond to like or similar components throughout the several figures, and beginning with FIG. 1, an engine assembly 12, which may be part of a vehicle 10, such as a car, truck, or motorcycle, includes a coolant manifold 20 capable of fluidly coupling a turbocharger 14 (TC) to an exhaust manifold 16 (EM). In the depicted embodiment, the engine assembly 12 includes a fluid conduit 40, such as a pipe, tube, or any suitable conduit, thermally coupled to the turbocharger 14. Accordingly, the coolant (i.e., the first coolant F1) flowing through the fluid conduit 40 can extract heat (i.e., the extracted turbocharger heat H1) from the turbocharger 14, thereby warming up the coolant flowing through the fluid conduit 40. The fluid conduit 40 is fluidly coupled to a coolant manifold 20. Therefore, hot coolant F1 can flow from the fluid conduit 40 to the coolant manifold 20. As discussed in detail below, the coolant manifold 20 can vent vapors V from the hot coolant F1 and direct the vapors V to a surge tank 18 (ST). The coolant manifold 20 is in fluid communication with a coolant gallery 30 that carries coolant (i.e., the second coolant F2). Thus, the hot coolant (i.e., the first coolant F1) can flow from the coolant manifold 20 to the coolant gallery 30. The coolant gallery 30 already contains coolant (i.e., the second coolant F2). Thus, the coolant coming from the coolant manifold 20 (i.e., the first coolant F1) is joined with the coolant flowing through the coolant gallery 30 (i.e., the second coolant F2), resulting in a mixed coolant F12. The coolant flowing through the coolant gallery (i.e., the second coolant F2 and the mixed coolant F12) can extract heat (i.e., the extracted exhaust heat H1) from the exhaust manifold 16.

In the depicted embodiment, the coolant manifold 20 may be referred to as a Y-manifold and is wholly or partly made of a rigid material, such as a rigid metal. The coolant manifold 20 includes a manifold body 21 and can carry coolant (i.e., the first coolant F1). In addition to the turbocharger 14 and the exhaust manifold 16, the coolant manifold 20 is fluidly coupled to the surge tank 18 (ST). As used herein, the term "surge tank" refers to a storage reservoir capable of absorbing sudden rises in pressure. In the depicted embodiment, the surge tank 18 can collect vapors V resulting from the hot coolant F. As discussed below, the coolant manifold 20 minimizes the amount of coolant (i.e., the first coolant F1 or second coolant F2) that ends up in the surge tank 18, because the liquefied portion of the coolant does not flow to the surge tank 18. Rather, the coolant manifold 20 vents the coolant in order to direct the vapors V of the coolant to the surge tank 18.

With reference to FIGS. 2-5, the engine assembly 12 includes an engine head 22 and a plurality of camshafts assemblies 24 supported by the engine head 22. The engine assembly 12 further includes the coolant manifold 20 directly coupled to the engine head 22. In the depicted embodiment, at least one fastener 26, such as a bolt, extends through the coolant manifold 20 and the engine head 22 in order to couple the coolant manifold 20 to the engine head 22. The exhaust manifold 16 can be integrated with the engine head 22. Therefore, the exhaust manifold 16 can be referred to as the integrated exhaust manifold.

Figure 5:
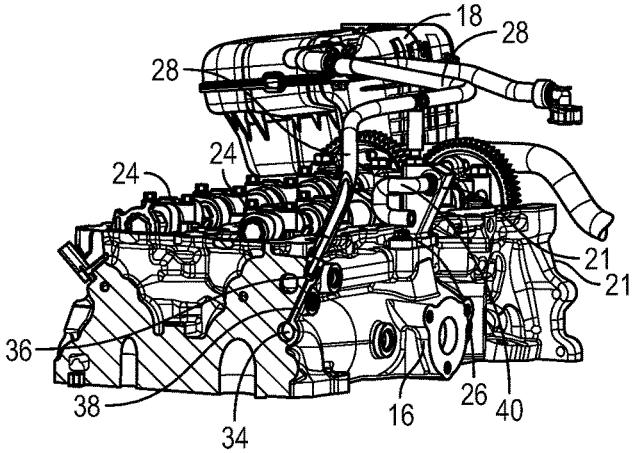
FIG. 5 is a schematic, sectional, perspective front view of the engine head and the coolant manifold, taken along section line 5-5 of FIG. 2.
Figure 6:
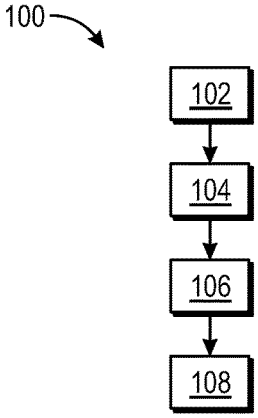
FIG. 6 is a flowchart of a method for operating the engine assembly of FIG. 1.

The engine assembly 12 further includes a venting conduit 28, such as a pipe, tube, or any conduit suitable to fluidly couple the coolant manifold 20 to the surge tank 18. The venting conduit 28 allows vapors V (FIG. 1) from the coolant to flow from the coolant manifold 20 to the surge tank 18. Consequently, vapors V in the coolant manifold 20 can flow to the surge tank 18 through the venting conduit 28. In addition to the coolant manifold 20, the venting conduit 28 is fluidly coupled to the engine cooling system 34 of the engine head 22. Accordingly, the vapors V in the engine cooling system 34 can flow to the surge tank 18 through the venting conduit 28. A T-coupling 32 can couple the venting conduit 28 to the coolant manifold 20 as shown in FIG. 5. A conduit vent 36 and a conduit vent orifice 38 are fluidly coupled the engine cooling system 34 and the venting conduit 28, thereby allowing vapors V to flow from the engine cooling system 34 to the surge tank 18 through the venting conduit 28.

The engine head 22 defines a coolant gallery 30 configured, shaped, and sized to carry coolant (i.e., the first coolant F1 and the second coolant F2) and is thermally coupled to the exhaust manifold 16. Accordingly, the coolant flowing through the coolant gallery 30 can extract heat (i.e., the extracted exhaust heat H2) from the exhaust manifold 16. In the depicted embodiment, the coolant gallery 30 is formed by the engine head 22 and can be a hole or opening extending through the engine head 22. In particular, the coolant gallery 30 is in direct fluid communication with the coolant manifold 20 and, therefore, coolant can flow from the coolant manifold 20 to the coolant gallery 30.

The coolant manifold 20 fluidly interconnects the fluid conduit 40, the venting conduit 28, and the coolant gallery 30. In the depicted embodiment, the coolant manifold 20 defines a venting orifice 42 and a joint vent 44 in fluid communication with the venting orifice 42. The joint vent 44 is in fluid communication with the venting conduit 28 thorough the T-coupling 32 and therefore allows vapor V to flow to the surge tank 18 through the venting conduit 28. The venting orifice 42 is also in fluid communication with the coolant gallery 30. Thus, vapors V can flow from the coolant gallery 30 to the surge tank 18.

The coolant manifold 20 also defines a joint passageway 46 obliquely angled relative to the venting orifice 42. In the depicted embodiment, the joint passageway 46 can be referred to as the turbocharger return passageway. The joint passageway 46 is fluidly coupled to the fluid conduit 40. Therefore, hot coolant can flow from the fluid conduit 40 to the coolant manifold 20 through the joint passageway 46. Another venting orifice 43 (i.e., a second venting orifice) can be in direct fluid communication with the joint vent 44 and the joint passageway 46, thereby allowing vapors V to flow from the joint passageway 46 to the surge tank 18 through the joint vent 44. The joint passageway 46 has a larger cross-sectional area than the venting orifices 42 and 43 in order to minimize the flow of liquid to the surge tank 18 through the venting orifices 42 and 43.

The coolant manifold 20 further defines an interconnection passageway 48 in direct fluid communication with the joint passageway 46 and the venting orifice 42. The interconnection passageway 48 is fluidly coupled to the coolant gallery 30 in order to facilitate fluid flow of liquefied coolant from the coolant manifold 20 to the coolant gallery 30. Moreover, the interconnection passageway 48 allows vapor V from the coolant F to flow to the surge tank 18 through the venting orifice 42. The joint passageway 46 is obliquely angled relative to the venting orifice 42 and the interconnection passageway 48 in order to facilitate the flow of coolant toward the coolant gallery 30 formed in the engine head 22. The interconnection passageway 48 and the joint passageway 46 each have a larger cross-sectional area than the venting orifices 42 and 43 in order to minimize the flow of liquid to the surge tank 18 through the venting orifice 42 and 43. The interconnection passageway 48 and the venting orifice 42 are parallel to each other in order to facilitate venting.

The engine assembly 12 can operate in accordance with the method 100. At step 102, coolant (i.e., the first coolant F1) flows through the fluid conduit 40 while heat is extracted from the turbocharger 14. As discussed above, because the fluid conduit 40 is thermally coupled to the turbocharger 14, the coolant can extract heat from the turbocharger 14 while it flows through the fluid conduit 40. The method 100 then proceeds to step 104. At step 104, the hot coolant flows from the fluid conduit 40 to the joint passageway 46 of the coolant manifold 20. Vapors V from the hot coolant (i.e., the first coolant F1 can flow through the venting orifice 43 and the joint vent 44 into the surge tank 18 through the venting conduit 28. In other words, the vapors V from the hot coolant are vented through the venting orifice 43 and the joint vent 44. Vapors V from the coolant flowing through the coolant gallery 30 can also be vented through the venting orifice 42 and the joint vent 44. Next, the method 100 continues to step 106. At step 106, the liquefied coolant continues to flow from the interconnection passageway 48 into the coolant gallery 30 formed by the engine head 22. Once in the coolant gallery 30, at step 108, the liquefied coolant from the coolant manifold 20 (i.e., the first coolant F1) is mixed with the coolant that is already flowing through the coolant gallery 30 (i.e., the second coolant F2). As discussed above, the coolant gallery 30 is thermally coupled to the exhaust manifold 16. Therefore, at step 108, the coolant flowing through the coolant gallery 30 can extract heat from the exhaust manifold 16. At this juncture, the hot coolant flowing through the coolant gallery 30 can be delivered to a thermal control module that is used, for example, to warm up engine oil and can help maintain the engine oil at its optimum temperature.

While the best modes for carrying out the teachings have been described in detail, those familiar with the art to which this disclosure relates will recognize various alternative designs and embodiments for practicing the teachings within the scope of the appended claims. Although the disclosed method is described in a specific chronological order, it is envisioned that the disclosed method may be performed in a different chronological order.

The invention claimed is:

1. An engine assembly, comprising:

a turbocharger;

a fluid conduit configured to carry a first coolant, wherein the fluid conduit is thermally coupled to the turbocharger such that the first coolant flowing through the fluid conduit extracts heat from the turbocharger;

a surge tank;

an engine head defining a coolant gallery, wherein the coolant gallery is configured to carry a second coolant;

an exhaust manifold integrated with the engine head, wherein the coolant gallery is thermally coupled to the exhaust manifold such that the second coolant extracts heat from the exhaust manifold;

a coolant manifold in fluid communication with the fluid conduit and the coolant gallery, wherein the coolant manifold defines:

a venting orifice in fluid communication with the surge tank in order to allow vapors to vent from the coolant manifold to the surge tank;

a joint passageway in fluid communication with the fluid conduit in order to allow the first coolant to flow from the fluid conduit to the coolant manifold;

an interconnection passageway fluidly interconnecting the joint passageway and the coolant gallery in order to allow the first coolant to flow from the joint passageway to the coolant gallery;

wherein the coolant manifold is downstream of the fluid conduit such that the first coolant flows from the fluid conduit directly to the coolant manifold; and wherein the coolant gallery is downstream of the fluid conduit such that the second coolant extracts heat from the exhaust manifold after the first coolant has extracted heat from the turbocharger.

2. The engine assembly of claim 1, wherein the joint passageway has a larger cross-sectional area than the venting orifice.

3. The engine assembly of claim 2, wherein the interconnection passageway has a larger cross-sectional area than the venting orifice.

4. The engine assembly of claim 1, wherein the coolant manifold is directly coupled to the engine head.

5. The engine assembly of claim 4, wherein the coolant gallery in direct fluid communication with the interconnection passageway.

6. The engine assembly of claim 5, further comprising at least one fastener extending through the coolant manifold and the engine head in order to couple the coolant manifold to the engine head.

7. The engine assembly of claim 1, wherein the joint passageway is obliquely angled relative to the venting orifice.

8. The engine assembly of claim 7, wherein the joint passageway is obliquely angled relative to the interconnection passageway.

9. The engine assembly of claim 1, further comprising a venting conduit fluidly interconnecting the surge tank and the venting orifice.

10. The engine assembly of claim 1, wherein the coolant manifold is configured to vent the coolant in order to direct the vapors of the coolant to the surge tank while a liquified portion of the coolant does not flow to the surge tank, the engine assembly further includes a venting conduit fluidly coupled to the coolant manifold, the venting conduit is configured to allow the vapors from the coolant to flow from the coolant manifold to the surge tank, the engine assembly further includes a T-coupling coupling the venting conduit to the coolant manifold, the engine assembly includes an engine cooling system, the venting conduit is fluidly coupled to the engine cooling system such that vapors in the engine cooling system are allowed to flow from the engine cooling system to the surge tank through the venting conduit, the venting orifice is a first venting orifice, the coolant manifold defines a second venting orifice to allow the vapors of the coolant to flow from the coolant manifold to the surge thank, the second venting orifice is in direct fluid communication with the joint passageway, the coolant manifold defines a joint vent in direct fluid communication with the first venting orifice, the joint vent is in fluid communication with the venting conduit through the T-coupling to allow the vapors of the coolant to flow to the surge tank through the venting conduit, the second venting orifice is in fluid communication with the joint vent, the interconnection passageway is in direct fluid communication with the joint passageway, the interconnection passageway is in direct fluid communication with the first venting orifice, and the interconnection passageway and the joint passageway each have a larger cross-sectional area than the first venting orifice and the second venting orifice.

11. The engine assembly of claim 10, wherein the coolant gallery is downstream of the coolant manifold such that the first coolant flows from the coolant manifold to the coolant gallery with the first coolant flowing from the coolant manifold being joined with the second coolant flowing through the coolant gallery, resulting in a mixed coolant, the coolant gallery is thermally coupled exhaust manifold such that the mixed coolant extracts heat from the exhaust manifold after the first coolant has extracted heat from the turbocharger.

* * * * *